United States Patent [19]

Rhyne

[11] Patent Number: 4,519,114

[45] Date of Patent: May 28, 1985

[54] APPARATUS AND METHOD FOR CLEANING TEXTILE FIBER

[75] Inventor: Ralph H. Rhyne, Belmont, N.C.

[73] Assignee: Rhyne Fibers, Inc., Belmont, N.C.

[21] Appl. No.: 450,139

[22] Filed: Dec. 15, 1982

[51] Int. Cl.[3] ..... D01G 1/00

[52] U.S. Cl. ..... 19/200; 19/205; 19/304; 209/250; 209/254

[58] Field of Search ..... 209/250, 254, 261–264, 209/364, 385, 20, 21, 22, 23, 365 R; 19/64.5, 97.5, 200, 202, 204, 205, 304, 80 R

[56] References Cited

U.S. PATENT DOCUMENTS

| | | | |
|---|---|---|---|
| 507,773 | 10/1893 | Bachman et al. . | |
| 655,299 | 8/1900 | Eberhardt . | |
| 1,026,432 | 5/1912 | Dey . | |
| 1,128,758 | 2/1915 | Cheesman . | |
| 1,458,870 | 6/1923 | Zoeller | 19/80 R |
| 1,468,028 | 9/1923 | Maussner et al. . | |
| 1,593,965 | 7/1926 | Cobb | 19/200 X |
| 1,605,196 | 11/1926 | Jgon . | |
| 1,909,951 | 5/1933 | Harris . | |
| 1,942,868 | 1/1934 | Mitchell | 19/204 X |
| 2,025,701 | 12/1935 | Mitchell | 19/202 X |
| 2,214,680 | 9/1940 | Sims . | |
| 2,845,661 | 8/1958 | Svende et al. | 19/304 |
| 3,308,344 | 3/1967 | Smith et al. | 19/200 X |
| 3,512,218 | 5/1970 | Langdon . | |
| 3,769,660 | 11/1973 | Schuette | 19/202 |
| 4,365,389 | 12/1982 | Beneke et al. | 19/205 X |

*Primary Examiner*—Louis K. Rimrodt

*Attorney, Agent, or Firm*—Richards, Shefte & Pinckney

[57] ABSTRACT

Apparatus and method for supplementary cleaning of cotton fibers employing a housing having an interior dividing screen separating the housing into two chambers and a fan adapted to entrain the fibers in a moving airstream and direct them into the housing against the screen for passage of the airstream and debris through the screen into one chamber and retention of the fiber in the other chamber. Reciprocably pivoting vanes divert the airstream back and forth across the screen to prevent accumulation of the fiber on the wall under the force of the airstream and to permit the fiber to fall from the wall after impact thereagainst. Alternatively, the conveying conduit may be movably mounted for side-to-side emission of the airstream into the housing. Ion emitters may be located at strategic locations to eliminate electrical attractive forces between the fibers and the debris.

14 Claims, 4 Drawing Figures

APPARATUS AND METHOD FOR CLEANING TEXTILE FIBER

BACKGROUND OF THE INVENTION

The present invention relates to the cleaning of textile fibers and particularly to apparatus and methods for removing relatively small particles of debris from cotton fibers which typically are not removed by ginning and other preliminary preparation and cleaning operations.

As is well known, harvested cotton characteristically has a considerable amount of debris and foreign matter therein, such as seed, boll, leaves, plant trash and ordinary dirt and dust, which must be substantially removed before the fiber can be processed into yarn. Ginning is the operation on which is primarily relied to perform the most substantial portion of such cleaning of cotton but, although ginning equipment and operations have been substantially improved over recent years to cope with the greater amounts of debris which result from mechanized harvesting, convential ginning is unable to remove all such debris, particularly the smaller particles of debris.

As a result, a wide variety of supplemental cleaning apparatus and methods have been proposed and used at various points throughout the conventional cotton processing system to attempt to perform further cleaning of the cotton fibers subsequent to ginning. Since it is common practice to convey fibers from one processing location to another by entraining the fibers in a moving airstream, one widely employed type of arrangement includes the provision of some form of screen or filter in the airstream path for separating the fibers from the airstream while enabling any particles of debris in the airstream to pass therewith through the screen. One nagging problem which occurs in this type of cleaning operation is the tendency of the fibers to be held against the screen by the airstream and to progressively accumulate on the screen. Various mechanisms have been devised to avoid this problem, including the use of rotating or moving screen arrangements, the provision of wipers or the like to periodically remove accumulated fibers from the screen and other similar arrangements. Unfortunately, such arrangements, while generally effective for their intended purpose, render the basic cleaning devices more complicated and correspondingly more costly.

In contrast, the present invention provides a screen-type apparatus and method for cleaning small debris particles from cotton fibers which is of a simple and inexpensive construction and operation effective to avoid fiber accumulation on the screen thereof without any complicated wiping or moving screen arrangements or the like and is adapted for use at virtually any location in the cotton processing system subsequent to ginning and prior to carding.

SUMMARY OF THE INVENTION

Briefly described, the present invention provides an apparatus and method for cleaning textile fibers wherein a pneumatic conveyor, preferably a high speed fan, is employed for creating a moving airstream and entraining therein the fibers to be cleaned, and a cleaner housing is employed for receiving the fiber entrained airstream and separating the debris from the fibers. The housing is substantially enclosed and includes a perforated interior dividing wall separating the housing into a fiber accumulating chamber and a trash accumulating chamber, the perforations of the dividing wall being of a selected size sufficient for passage therethrough of debris on said fibers but to prevent passage therethrough of the fibers. The fiber entrained airstream produced by the pneumatic conveyor is directed by suitable means into the fiber accumulating chamber of the housing toward the dividing wall for impact thereagainst to separate the debris from the fibers by passage of the debris with the airstream through the dividing wall into the debris accumulating chamber and retention of the fibers in the fiber accumulating chamber. A movable airstream directing arrangement reciprocably directs the fiber entrained airstream back and forth across the transverse extent of the dividing wall to prevent the accumulation of the fibers on the wall under the retaining impetus of the fiber entrained airstream and to permit the fibers to gravitationally fall from the wall following the impact thereagainst.

In one embodiment, the reciprocal direction of the airstream is caused by a pair of airstream deflector vanes pivotably mounted in the housing on opposite sides of the location of receipt of the airstream and operatively connected for pivotal reciprocatory parallel movement in unison. In another embodiment, the reciprocal direction of the airstream is provided by an airstream conveying conduit between the pneumatic conveyor and the housing which conduit is movable from side-to-side of the housing to discharge the airstream back and forth across the dividing wall.

Preferably, the fibers collected in the fiber accumulating chamber are withdrawn from the lower end thereof by a suitable arrangement communicating therewith and are transported to a location of further processing, such as a bale press or a picker. The dividing wall is a screen arranged vertically in the housing and has an inclined lower portion arranged to direct the collected fibers to the withdrawal arrangement. The high speed fan of the pneumatic conveyor is arranged to create a high velocity moving airstream to cause the fibers entrained therein to be impacted against the dividing wall with sufficient force to cause loosening and separation of the debris from the fibers. Conveniently, a door is provided opening into the debris accumulating chamber for withdrawal therefrom of the collected debris.

It is also preferred that ion emitters be provided at predetermined locations intermediate the fan and the housing and in the fiber accumulating chamber in the housing for discharging ions into the airstream to neutralize static electrical charges in the fibers to eliminate electrical attractive forces between the fibers and the debris.

DESCRIPTION OF THE PREFERRED EMBODIMENT

Referring now to the accompanying drawings, two embodiments of the cleaning apparatus and method of the present invention are herein illustrated and described. It is to be understood that the present apparatus and method may be employed at substantially any location in the conventional cotton processing system for supplementary cleaning of cotton fibers to remove small debris particles therefrom. Thus, for example, the present invention may be employed intermediate ginning equipment and baling equipment in the initial system of processing harvested cotton. Alternatively, the present invention may be employed in a typical yarn formation system at any location subsequent to bale opening equipment and in advance of card lap formation. Such other equipment is well known in the art and forms no part of the present invention and therefore will not be described in detail herein.

Figure 1:
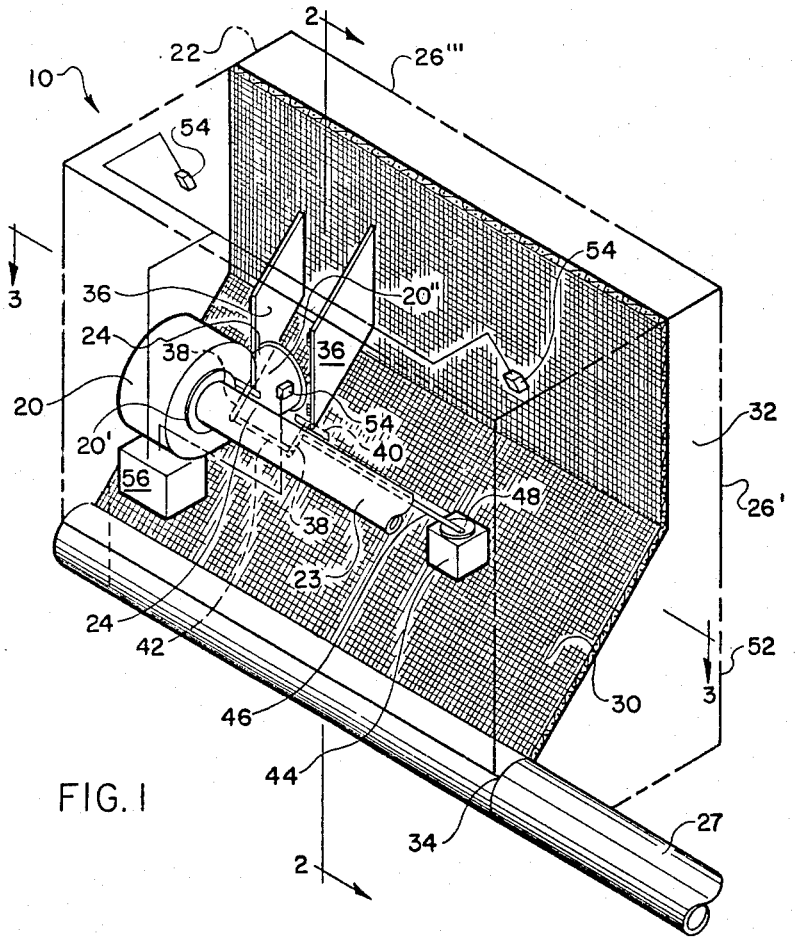
FIG. 1 is a perspective view of a fiber cleaning apparatus according to one embodiment of the present invention, the cleaner housing of the apparatus being shown in phantom lines to enhance the clarity of illustration of the apparatus.
Figure 2:
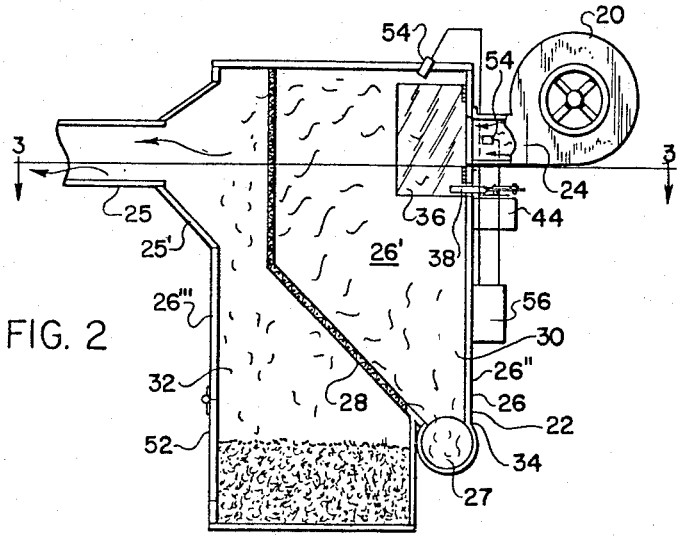
FIG. 2 is a vertical sectional view of the apparatus of FIG. 1 taken along line 2—2 thereof.
Figure 3:
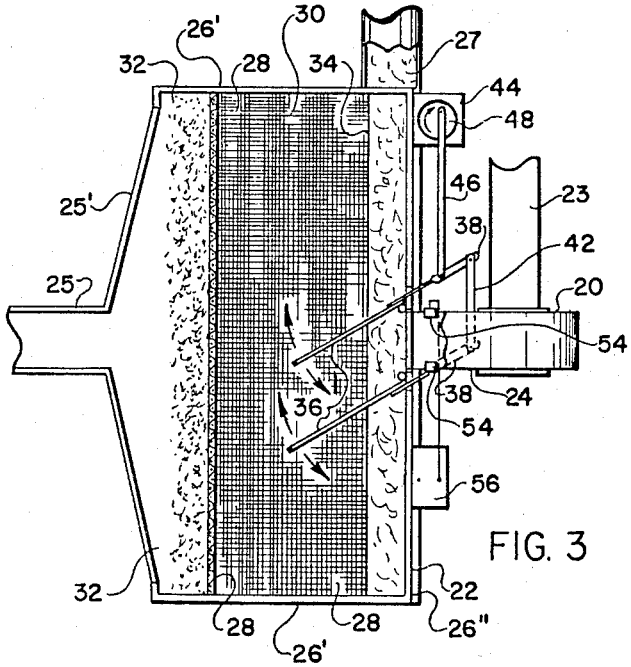
FIG. 3 is a horizontal sectional view of the apparatus of FIG. 1 taken along line 3—3 thereof.

One embodiment of the supplementary cleaning apparatus 10 is shown in FIGS. 1–3 and basically includes a high-speed fan 20 connected to a cleaner housing 22 by a suitable tubular conduit 24. The housing 22 is a substantially enclosed, upstanding rectangularly-shaped hollow box 26 fabricated of sheet metal or another suitable material and includes a perforated interior dividing wall 28 extending generally vertically for substantially the full height of the box 26 and horizontally between the transverse side walls 26' of the box 26 to divide the housing 22 into a fiber accumulating chamber 30 and a debris accumulating chamber 32 on respective opposite sides of the wall 28. The fan 20 is of a conventional centrifugal type, its intake 20' being connected through a conduit section 23 in fluid communication with a source of fiber, such as the output of ginning equipment, a bale opener or the like, and its output 20'' being connected through the horizontally extending conduit section 24 with the front wall 26'' of the box 26 on the side threrof of the fiber accumulating chamber 30 and opening thereinto. Another conduit section 27 is connected to the box 26 at the lower end thereof and opens into the fiber accumulating chamber 30, and extends therefrom to further processing equipment, such as to the intake of a baling apparatus, a picker, a chute-feed to a card, or the like. An airstream exhaust conduit 25 and manifold 25' is connected to the rear wall 26''' of the box 26 and opens into the debris accumulating chamber 32. A door 52 is provided in the rear wall 26''' at its lower end providing access into the debris accumulating chamber 32.

As will be understood, conventional processing of the fiber which precedes the present apparatus (e.g. ginning) is ordinarily effective to remove most large particles of debris and foreign matter but such processes are generally unable to extract smaller particles which may include ordinary dirt, dust, leaf, boll and vegetable particles from the cotton plant, and other similar debris. The perforations of the dividing wall 28 are preferably of a selected size sufficiently large for passage therethrough of the aforesaid foreign matter, but sufficiently small to prevent passage therethrough of the cotton fibers. Preferably the dividing wall 28 is constructed of a screen material, the guage of which may be selectively coarse or fine as desired or necessary. The front wall 26'' is stepped inwardly at 34 at a small spacing above its lower end at the location of which stepped area the conduit section 27 opens into the fiber accumulating chamber 30. The screen of the dividing wall 28 extends vertically downwardly from the top of the box 26 to an intermediate point and extends angularly forwardly at a downward incline to the inward corner of the step 34 in the front wall 26''. As will be explained more fully hereinafter, the fan 20 is of a sufficient high speed capacity to convey cotton fibers in the conduit 24 at a sufficient velocity to be discharged therefrom into the fiber accumulating chamber 30 substantially horizontally to be impacted against the dividing wall 28.

As best seen in FIG. 2, a pair of planar vanes 36 are hingedly mounted to the inward face of the front wall 26'' of the box 26 on opposite sides of the terminal end of the conduit section 24. Each vane 36 has affixed to its lower end an operating arm 38 which extends outwardly through a respective horizontal slot 40 in the front wall 26''. The two operating arms 38 are operatively connected by a cross link 42, the respective ends of which are pivoted to the outwardly extending ends of the arms 38 whereby the arms 38 and their associated vanes 36 are caused to move pivotably in parallel relation and in unison with one another. An electrically-operated motor 44 is mounted to the outward face of the front wall 26'' adjacent one side of the operating arm arrangement, a driving link 46 being pivotably affixed at one end thereof eccentrically to a drive wheel 48 driven by the motor 44, and the driving link 46 being pivotably affixed at its other end to one of the operating arms 38 whereby operation of the motor 44 is effective to reciprocably pivot the vanes 36 back and forth.

The method of operation carried out by the present apparatus will thus be understood. The fan 20 and the motor 44 are initially energized together with the other components of the processing system. Cotton fibers are conveyed through the conduit section 23 to the intake 20' of the fan 20 which operates to produce a rapidly moving airstream exiting from its output 20'' and to entrain the cotton fibers in the airstream. The fibers are pneumatically transported through the conduit section 24 and across the fiber accumulating chamber 30, and are impacted with significant force against the dividing wall 28 as the airstream passes therethrough. The impact of the fibers against the dividing wall 28 is effective to loosen and separate a significant amount of the foreign matter from the fiber, most of which, because of its relatively small size, will be carried with the airstream through the perforations of the dividing wall 28 into the debris accumulating chamber 32 wherein the debris settles and accumulates at the bottom. The door 52 permits periodic removal of the collected debris as necessary. The airstream continues through the debris accumulating chamber 32 and the exhaust conduit 25 in the rear wall of the box 26 to prevent the possibility of removed debris again passing through the dividing wall 28 into the fiber accumulating chamber 30. Under ideal circumstances, the cotton fibers will fall gravitationally from the dividing wall 28 following their impact thereagainst. However, as will be understood, there exists a natural tendency that the moving force of the airstream will effectively hold some portion of the fibers against the wall 28, whereupon a progressive accumulation of fibers on the wall 28 may clog the desired escape path of the airstream and debris and negate the desired cleaning to be achieved. The reciprocating vanes 36 prevent this occurrence by channeling the airstream in a constantly changing directional path so that it is channeled back and forth across the transverse or widthwise extent of the dividing wall 28, whereby the airstream is continuously diverted away from fibers following their impact against the dividing wall 28 to permit the fibers to gravitationally fall freely therefrom and along the inclined lower portion thereof into the withdrawal conduit 27 to be carried to a location of further processing, e.g., a bale press or a picker. In this manner, the accumulation of fibers on the dividing wall 28 under the retaining impetus of the airstream is effectively prevented and the intended manner of operation of the present apparatus and method is greatly and benefically enhanced. Advantageously, the cleaner cotton fibers produced with the present invention enable the yarn producer to spin a cleaner, higher quality spun yarn with the fibers.

Figure 4:
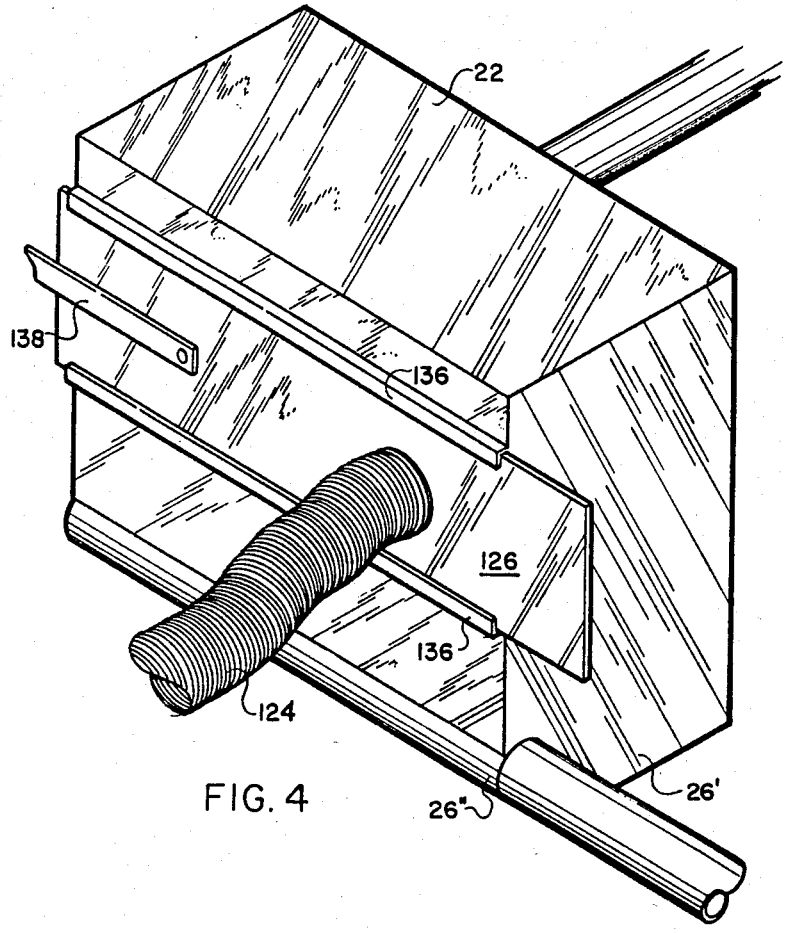
FIG. 4 is a perspective view of a fiber cleaning apparatus similar to that of FIG. 1 according to a second embodiment of the present invention.

In FIG. 4, there is illustrated an alternative embodiment of the present invention wherein the arrangement of the diverting vanes 36 is eliminated, and the desired back-and-forth direction of the airstream is provided by employing a length of conventional flexible tubing 124 for the conduit section 24 which is connected to a horizontally extending panel 126 which is slidably mounted in channel members 136 attached to front wall 26'' for reciprocable, side-to-side movement. Suitable roller bearings or the like (not shown) may be affixed to the upper and lower edges of the panel 126 to facilitate the desired reciprocable, sliding movement thereof. An operating arm 138 is pivotably affixed centrally to the panel 126 and extends therefrom to an operating motor (not shown) which may be substantially similar to motor 44 to control the desired sliding reciprocation of the panel 126. As will be understood, the side-to-side sliding movement of the panel 126 provides substantially the same back and forth diversion of the airstream as provided by the vanes 36 with the same results as described above. It will be appreciated that other mechanical arrangements could be utilized to obtain the aforesaid movement of the airstream and entrained fiber without departing from the present invention.

It is known that the conventional mechanical handling of textile fibers tends to produce static electrical charges in the fibers and debris therein creating an electrical attraction between the fibers and debris which may be difficult to overcome in cleaning operations. To neutralize such static electrical charges, the present apparatus is provided at strategic locations along the airstream path with one or more ion emitters 54 operated by a power unit 56 to emit charged ions into the airstream prior to its impact against the dividing wall 28, thereby eliminating any electrical attractive forces between the fibers and the debris so as to enable the cleaning process of the present apparatus to be carried out most efficiently. A wide variety of such ion emitters and power units are conventionally available from various companies, one example being ENER-JET brand static eliminating equipment manufactured and sold by Consan Pacific, Inc., Whittier, Calif. Preferably, a pair of emitters 54 are disposed at and extend through, each side of the conduit 24, and another pair of emitters 54 are disposed at, and extend through, the top wall of the box 26 at opposite sides thereof. Additionaly, emitters may be located, if desired, along the conduits 23 and 27 if static electricity proves to be a particularly bothersome problem in certain installations.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. In an apparatus for cleaning textile fibers comprising a substantially enclosed cleaner housing having a perforated interior dividing wall separating said housing into a trash accumulating chamber and a fiber accumulating chamber, the perforations of said dividing wall being of a selected size sufficient for passage therethrough of debris on said fibers but to prevent passage therethrough of said fibers, fiber directing means associated with said cleaner housing for directing said fibers into said fiber accumulating chamber in a direction toward said dividing wall, and pneumatic conveying means associated with said airstream directing means upstream of said fiber accumulating chamber for creating a moving airstream for entraining said fibers therein and impelling said fibers through said airstream directing means into said fiber accumulating chamber for impact with said dividing wall to cause separation of said debris from said fibers by passage of said debris with said airstream through said perforations into said debris accumulating chamber and retention of said fibers in said accumulating chamber, the improvement comprising a pair of planar deflecting vanes pivotably mounted in said housing on opposite sides of said airstream directing means and operably connected for reciprocatory movement in generally parallel relation for reciprocably directing said fiber entrained airstream back and forth across the transverse extent of said dividing wall, whereby said fiber entrained airstream is continuously diverted away from said fibers following their impact against said dividing wall to prevent extended or progressive accumulation of said fibers on said dividing wall under the retaining impetus of said fiber entrained airstream and to permit said fibers to gravitationally fall from said dividing wall following said impact thereagainst.

2. Apparatus for cleaning textile fibers according to claim 1 and characterized further in that said dividing wall comprises a screen disposed generally vertically in said housing.

3. Apparatus for cleaning textile fibers according to claim 2 and characterized further by fiber withdrawal means in operative fluid communication with said housing at the lower end of said fiber accumulating chamber for withdrawing said fibers therefrom.

4. Apparatus for cleaning textile fibers according to claim 3 and characterized further in that said screen includes an inclined lower portion for directing said usable fibers to said fiber withdrawal means.

5. Apparatus for cleaning textile fibers according to claim 1 and characterized further in that said pneumatic conveying means includes high speed fan means arranged to create said moving airstream at a sufficiently high velocity to cause said fibers entrained therein to be impacted against said dividing wall with sufficient force to cause loosening and separation of said debris from said fibers.

6. Apparatus for cleaning textile fibers according to claim 1 and characterized further by means for emitting ions into said fiber entrained airstream for neutralizing static electrical charges in said fibers to eliminate electrical attractive forces between said fibers and said debris.

7. Apparatus for cleaning textile fibers according to claim 6 and characterized further in that said ion emitting means includes at least one ion emitter disposed intermediate said pneumatic conveying means and said housing and at least one other ion emitter disposed in said fiber accumulating chamber of said housing.

8. Apparatus for cleaning textile fibers according to claim 1 and characterized further in that said housing includes a door opening into said debris accumulating chamber for withdrawal therefrom of said debris collected therein.

9. In a method of cleaning textile fibers comprising the steps of providing a substantially enclosed housing having a perforated interior dividing wall separating said housing into a trash accumulating chamber and a fiber accumulating chamber, the perforations of said dividing wall being of a selected size sufficient for passage therethrough of debris on said fibers but to prevent passage therethrough of said fibers, creating a moving impelling airstream upstream of said chambers, entraining said fibers in said airstream, directing said fiber entrained airstream into said fiber accumulating chamber of said housing in a direction toward said dividing wall and causing said fiber entrained airstream to impact thereagainst to separate said debris from said fibers by passage of said debris with said airstream through said perforations into said debris accumulating chamber and retention of said fibers in said fiber accumulating chamber, the improvement comprising reciprocably directing said fiber entrained airstream back and forth across the transverse extent of said dividing wall, whereby said fiber entrained airstream is continuously diverted away from said fibers following their impact against said dividing wall to prevent extended or progressive accumulation of said fibers on said dividing wall under the retaining impetus of said fiber entrained airstream and to permit said fibers to gravitationally fall from said dividing wall following their impact thereagainst.

10. A method of cleaning textile fibers according to claim 9 and characterized further in that said reciprocably directing includes conveying said airstream in a predetermined flow path into said fiber accumulating chamber and deflecting said airstream in said fiber accumulating chamber in a constantly changing direction back and forth across said dividing wall.

11. A method of cleaning textile fibers according to claim 9 and characterized further in that said directing said airstream into said fiber accumulating chamber includes conveying said airstream through a conduit extending between said pneumatic conveying means and said housing, and said reciprocably directing includes moving said conduit from side-to-side of said housing to discharge said airstream back and forth across said dividing wall.

12. A method of cleaning textile fibers according to claim 9 and characterized further in that said airstream creating includes creating said moving airstream of a sufficiently high velocity to cause said fibers entrained therein to be impacted against said dividing wall with sufficient force to cause loosening and separation of said debris from said fibers.

13. A method of cleaning textile fibers according to claim 9 and characterized further by emitting ions into said fiber entraining airstream for neutralizing static electrical charges in said fibers to eliminate electrical attractive forces between said fibers and said debris.

14. A method of cleaning textile fibers according to claim 13 and characterized further in that said emitting includes discharging ions into said airstream intermediate said pneumatic conveying means and said housing and discharging ions into said airstream within said fiber accumulating chamber of said housing.

* * * * *